US005090286A

United States Patent [19]

Ward

[11] Patent Number: 5,090,286

[45] Date of Patent: Feb. 25, 1992

[54] FOOD SLICING GUIDE

[76] Inventor: William H. Ward, 803 E. 53rd St., Kansas City, Mo. 64110

[21] Appl. No.: 657,660

[22] Filed: Feb. 19, 1991

[51] Int. Cl.[5] ..... B26B 29/06

[52] U.S. Cl. ..... 83/761; 83/732

[58] Field of Search ..... 83/761, 268, 932, 42, 83/703, 762

[56] References Cited

U.S. PATENT DOCUMENTS

| | | | |
|---|---|---|---|
| 638,135 | 11/1899 | Osborn | 83/762 |
| 1,053,147 | 2/1913 | Bennett | 83/762 |
| 2,649,658 | 8/1953 | Nelson | 83/761 |

*Primary Examiner*—Frank T. Yost
*Assistant Examiner*—Ken Peterson
*Attorney, Agent, or Firm*—Litman, McMahon & Brown

[57] ABSTRACT

A food-slicing guide device for guiding a knife in slicing portions of food comprises a platform and a bail. A pair of opposing slots spaced along the lateral edges of the platform are adapted to align the bail either perpendicularly to the platform while using the device as a food-slicing guide, or longitudinally with the platform when storing or transporting the device. The slots are adapted to permit either side or either end of the platform to be used for slicing purposes, thereby permitting the abrasion caused by contact between a slicing utensil and the platform to be distributed at various times at different areas, thus reducing the abrasion effects and extending the useful life of the device. The bail is constructed of resilient material and the interacting corners of the slots are eased whereby the bail readily snaps into slicing position. For storage, the bail pivotally rotates to a resting position in a pair of V-shaped grooves along the edges of the platform.

6 Claims, 2 Drawing Sheets

FOOD SLICING GUIDE

BACKGROUND OF THE INVENTION

The present invention relates to a device for positioning food, such as bread, and guiding a knife while slicing portions therefrom.

A select few individuals are sufficiently talented to adeptly ply the culinarian's art and slice food in uniform, artistically pleasing slices, with nothing more than a pair of steady hands and a sharp slicing utensil. The majority of individuals attempting to slice food, however, are not so talented and produce severed portions of food having an uneven thickness.

Several conventional devices exist that have been developed in an attempt to close the gap between the talented and the untalented. While some of these prior art devices are applicable to a variety of foods, many are limited in use.

Also, devices which have permanently-secured, perpendicularly-extending guides, or which extend substantially three-dimensionally, may provide a cutting edge for slicing breads or other foods, but result in storage problems because of the spatial requirements needed therefor. Even prior art devices which may be disassembled for storage purposes generally have one or more parts extending substantially in three-dimension.

Furthermore, prior art devices have generally failed to allow for the abrasion which occurs when the cutting edge of the slicing utensil comes into contact with the platform, which abrasions eventually substantially reduce the attractiveness of the device and the ease with which the device can be sanitized after each use thereof.

SUMMARY OF THE INVENTION

An improved food-slicing guide device is provided to assist with the slicing of food, particularly a loaf of bread. The device comprises a platform or base and a bail. The platform is preferably constructed of laminated strips of hardwood, such as birch, ash, oak, walnut, or other suitable material. Two opposing sides of the platform each have a longitudinally-disposed V-shaped groove carved therein. Two pairs of opposing slots with bores centrally located therein are also disposed in the grooved edges and are adapted to direct the bail in an orientation perpendicular to the platform for slicing purposes.

The bail is preferably constructed of stainless steel or other suitable resilient material. Distal ends of the bail are oriented in coaxial alignment and are inserted in the bores of one of the pairs of opposing slots. The bail is biased to urge the ends thereof inwardly, and the bores in the slots serve as pivoting points for rotation of the bail relative to the platform.

For storage purposes, the legs of the bail lie within or alongside the grooved edges of the platform, with the arcuate portion of the bail disposed substantially across one end of the platform. A cutout in each end of the platform provides an opening in conjunction with the end of the bail sized to receive the fingers from a hand therethrough whereby the fingers of a user can be curled around the bail for carrying purposes, for grasping the bail to raise same to an operable position and to allow the bail to be used as a hanger during storage. In particular, the cutout provides an attractive feature for insertion of suspension means such as a nail, hook, or peg for storing or displaying the apparatus when not in use.

When converting the apparatus to its food-slicing configuration, the arcuate portion of the bail is grasped by the fingers and pulled so as to rotate upward and away from one of the faces of the platform such that the bail pivots about the bores in the slots. The outer corners of the slots between the bail and the closest end of the board on a cutting side of the bail are eased to facilitate the perpendicular alignment of the bail with the slots, causing the bail to readily snap into a secure slicing position. Opposite corners of the slots on the non-cutting side of the bail are not eased and are generally parallel to the plane of the non-cutting side of the bail so as to be urged against lower ends of the bail during use and support the bail in an upright position as a user slices food using the bail as a guide.

When returning the slicing apparatus to its storing position, a user pushes the top of the bail toward the nearest end of the board such that the lower ends of the bail rotate along the eased corners of the slot and slide along opposite sides of the board to the storage position. The legs of the bail seat in V-grooves in the sides of the platform when in the storage position and are biased toward the grooves so as to remain therein until a user again converts the apparatus to a use configuration thereof. That is, the resiliency of the bail causes the bail to be retained in the V-grooves for storing.

The platform includes a first face and a second face and is designed so that an item of food to be sliced may be positioned on either face. The bail is selectively and alternatively positionable within either pair of opposing slots with bores and is rotatably positionable so as to extend perpendicularly above and away from either face thereby providing four cutting areas on the platform. The multiple cutting areas reduce the wear on the platform caused by repeated contact with a knife in one area and thereby increase the useful life of the food slicing guide. The board is also designed to be easily reversed to facilitate use by both right and left-handed users.

OBJECTS AND ADVANTAGES OF THE INVENTION

Therefore, the objects of the present invention are: to provide a device for a food-slicing guide; to provide such a device which is self-contained; to provide such a device having a bail which provides a two-point guide for controlling a slicing utensil relative to the food being sliced and, therefore, providing accurate control of the thickness and uniformity of each slice of the food; to provide such a device which guides the slicing utensil such that it travels substantially perpendicularly to a food-supporting platform of the device; to provide such a device wherein the bail has substantially two preferred positions with one of those positions being substantially perpendicular to the plane of the food-supporting platform and a storage position wherein the bail is substantially parallel to the plane of the food-supporting platform; to provide such a device wherein the bail is lockably supported in an upright position against pressure applied to a cutting side of the bail in the perpendicular position or use configuration and which allows the bail to be easily rotated from the use configuration to the storage position thereof by pressure from the user against the non-cutting side of the bail; to provide such a device which exposes a variety of areas of the platform to the abrasiveness of the slicing utensil such that the wear resulting from usage of the device can be distributed to several different areas, thereby prolonging the useful life of the device; to provide such a device having cutouts near the ends of the platform which, in conjunction with the bail form openings that receive the hand of a user and facilitate carrying or hanging the device; to provide such a device having a platform constructed of parallel strips of material laminated together in side-by-side relationship; and to generally provide such a device which is relatively easy to use, simple to maintain, reliable in performance, inexpensive to manufacture, and which generally performs the requirements of its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
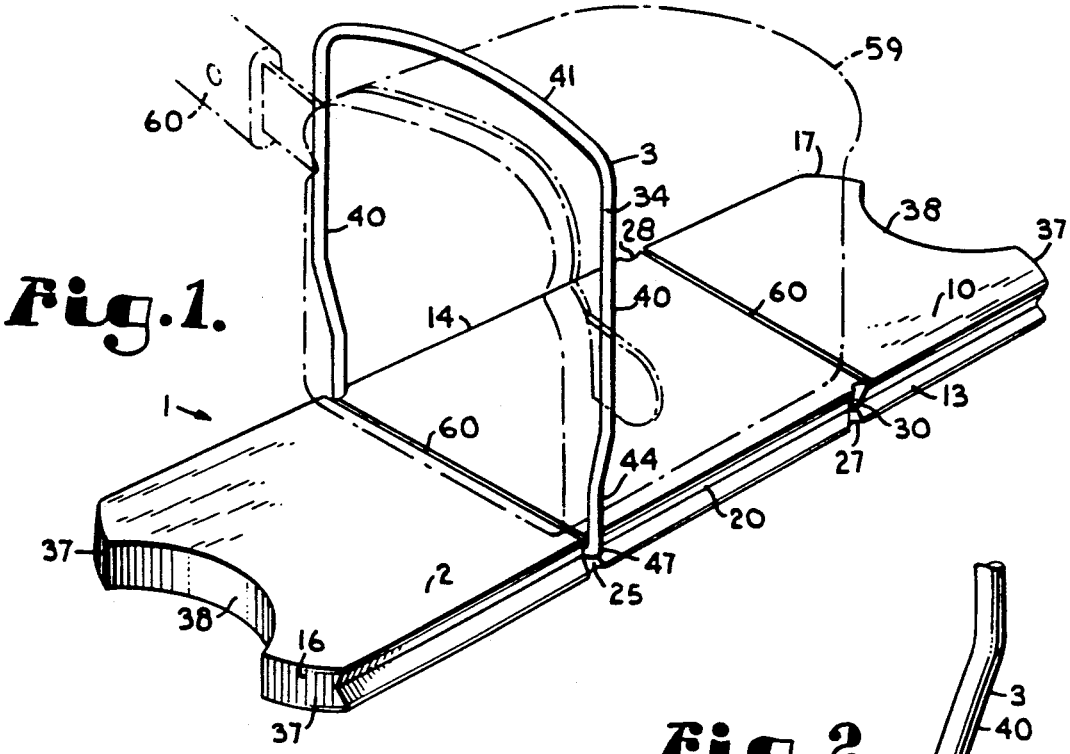
FIG. 1 is a perspective view of the food slicing guide of the present invention comprising a planar base and a bail positioned in a food slicing or use configuration in perpendicular alignment thereto and showing a guiding function of the bail in guiding a knife in slicing a loaf of bread shown in phantom lines positioned on the planar base.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail the reference numeral 1 generally represents a food slicing guide of the present invention. The food slicing guide 1 comprises a platform or base 2 and guide means or bail 3.

The base 2 is generally formed of hardwood, but may be constructed of plastic or other materials suitable for use as a cutting board. The base 2 includes a first face 10 and an opposingly directed coplannar and mirror image second face 11 each adapted to support an item of food to be sliced thereon. The base 2 further includes opposed first side 13 and second side 14 extending in parallel alignment from a first end 16 to a second end 17 of the base 2. A V-shaped groove 20 extends along the length of the first and second opposed sides 13 and 14 of the base 2.

A first slot 25, a second slot 26, a third slot 27 and a fourth slot 28 extend into the base 2 from the first and second opposed sides 13 and 14 in perpendicular alignment thereto and each extend between said first face 10 and said second face 11. The first slot 25 and the third slot 27 extend inward from the first opposed side 13 and the second slot 26 and the fourth slot 27 extend inward from the second opposed side 14 such that the first slot 25 and the second slot 26 are oppositely aligned and the third slot 27 and the fourth slot 28 are oppositely aligned and an imaginary line connecting same is perpendicular to the sides 13 and 14.

Figure 5:
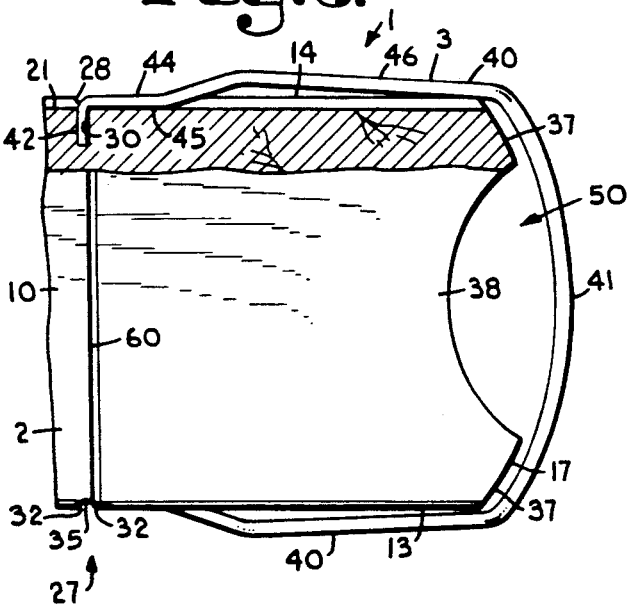
FIG. 5 is a fragmentary and enlarged top plan view of the device showing the bail in a second set of receiving slots and in the storage position thereof.
Figure 7:
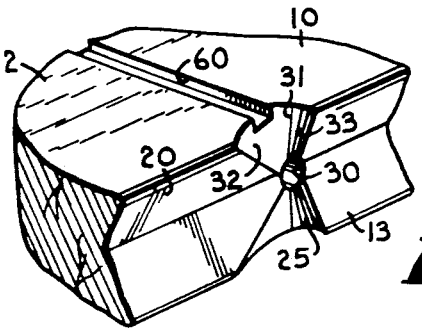
FIG. 7 is a further enlarged and fragmentary view of the device showing detail of the bail receiving slot of the platform.

As best shown in FIGS. 5 and 7, a bore 30 extends partially into the base 2 from an inner surface 31 of each of the first, second, third and fourth slots 25–28.

Figure 4:
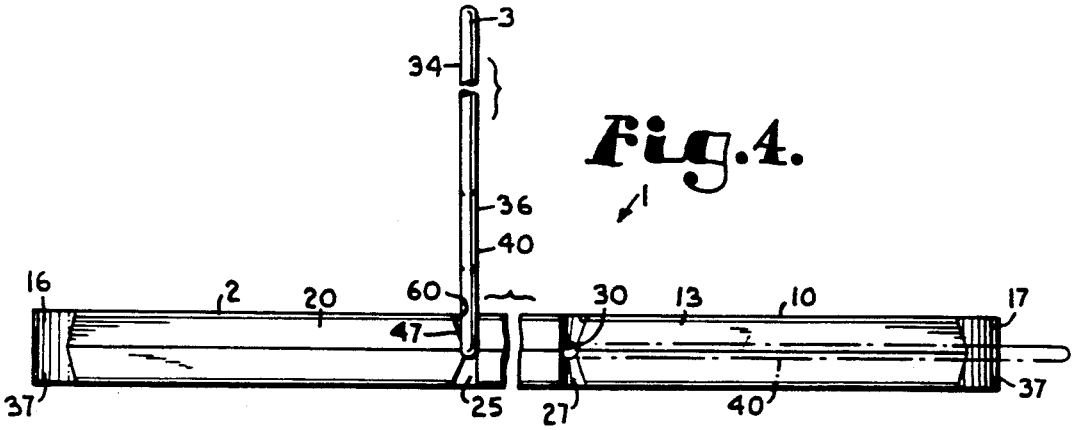
FIG. 4 is an enlarged side elevational view of the apparatus of the present invention, showing the bail in the food slicing configuration in solid lines and the storage configuration in phantom lines.

The slots 25 to 28 are each shaped so that when viewed from the top, each has a first corner 32 that is closest to a respective end 16 or 17 having surfaces that extend along both respective base side 13 or 14 and into a respective slot 25 to 28 that is eased or substantially arcuate so that the corners 32 allow relatively easy sliding movement of the bail 3 from the use position (solid lines in FIG. 4) to the storage position (phantom lines in FIG. 4) thereof. An opposite corner 33 of each slot 25 to 28 has an inner surface that extends generally perpendicular to a respective side 13 or 14 of the base 2 and likewise generally parallel to a plane formed on either opposite sides (cutting side 34 and non-cutting side 36) of the bail 3 when the bail 3 is in the use configuration shown in FIG. 1 and an outer surface that extends along a respective base side 13 or 14. The corners 33 support the bail 3 in the upright or use position shown in FIG. 1 and generally prevent pressure against the cutting side 34 of the bail 3 from causing the bail 3 to fold or rotate relative to the base 2, whereas pressure against the non-cutting side 36 of the bail 3 does cause such rotation relative to the base 2. A rear or inner portion 35 of each slot 25 to 28 is arcuate and has a radius approximately that of the legs 40 of the bail 3.

The first end 16 and the second end 17 of the base 2 each include arcuate portions 37 and a semicircular cutout portion 38 curved opposite the arcuate portions 37. The cutout portions 38 are positioned to facilitate grasping of the bail 3 by a user when in the storage configuration thereof.

Figure 2:
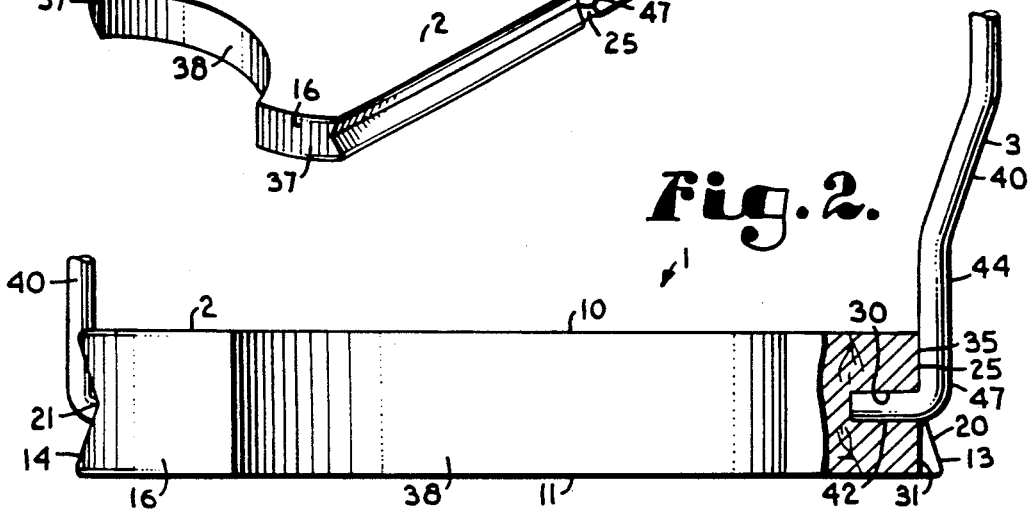
FIG. 2 is an enlarged and fragmentary end view of the apparatus of the present invention with portions broken away to show detail thereof.
Figure 3:
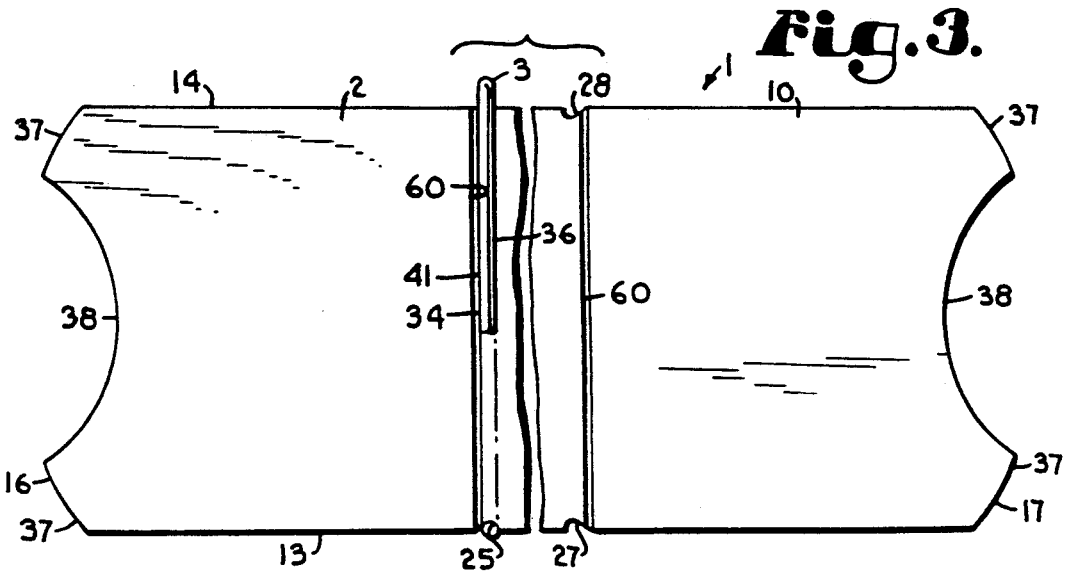
FIG. 3 is a enlarged and fragmentary top plan view of the apparatus of the present invention with portions broken away to show detail, showing the bail positioned in the food slicing configuration thereof.

The bail 3 is preferably formed from a strand or length of stainless steel wire but may be formed of other resilient materials such as plastic. The strand is bent or formed so that the bail 3 is generally U-shaped having a pair of opposed legs 40, an arcuate cross-member 41, and a pair of inwardly directed distal ends 42. As shown in FIG. 2 the opposed legs 40, near the arcuate cross-member 41 are spaced apart a distance approximately equal to the distance between the V-shaped grooves 20 in the first and second opposed sides 13 and 14. The distal ends 42 of the bail 3 are biased slightly inward by inherent resiliency of the wire forming the bail 3 to return to a preconfigured shape so as to grip the base 2 and snap into the slots 25 to 28 when placed in the use position thereof and to snap the legs 40 into the V-shaped grooves 20 when placed in the storage position thereof.

Near the lower end (that is, the end connected to the base 2) of each bail leg 40, the legs 40 are bent so as to have an inwardly directed or facing jog region 44 that extends approximately 2 inches from the leg ends 42. The jog regions 44 have a lower section 45 generally parallel to an upper portion 46 of a respective leg 40 that snugly and abuttingly seats in a respective V-shaped groove 20 of the base 2 when in the bail 3 is in the storage position thereof (see FIGS. 5 and 6), while the upper portion 46 of the leg 40 is spaced from the groove 20. Because the jog regions 44 space the upper leg portions 46 from the grooves 20, movement of the bail from the storage position to use position thereof requires less force than would be required if substantially the entire legs 40 were within respective grooves 20, yet the lower section 45 of each jog region 44 snaps snugly into a respective groove 20, when the bail 3 is moved from the use position to the storage position thereof.

The bail 3 is selectively securable to the base 2 so that the distal ends 42 of the bail 3 are rotatably received within the bores 30 of either the first slot 25 and the second slot 26 or, alternatively, the third slot 27 and the fourth slot 28. Secured to the base 2, the bail 3 may be rotatably positioned in a perpendicular alignment or a coplanar alignment relative to the faces 10 and 11 of the base 2. When the bail is positioned in perpendicular alignment with the base 2, a stub portion 47 of each of the opposed legs 40 is received within the first slot 25 and the second slot 26 respectively or, alternatively, the third slot 27 and the fourth slot 28 respectively so that the stub portion 47 abuts against a respective support corner 33 such that the corners 33 function as stops to rotary movement of the top of the bail 3 away from the nearest base end 16 or 17 and so as to maintain the bail 3 in perpendicular alignment with respect to the base 2.

To advance the bail 3 to a coplanar alignment with the base 2, the arcuate cross-member 41 is urged towards the first end 16 of the base 2 if the bail 3 is positioned in the first and second slot 25 and 26 or towards the second end 17 of the planar base 2 if the bail 3 is positioned in the third and fourth slots 27 and 28 and closely aligns with the base end arcuate portions 37. The edges of corners of the first, second, third and fourth slots 25–28 nearest respective ends 16 and 17 are rounded such that the urging of the arcuate cross-member 41 of the bail 3 towards the first end 16 or the second end 17 biases the lower portion 47 of the opposed legs 40 outwardly and along the edge of a respective groove 20 and finally into a respective groove 20.

Figure 6:
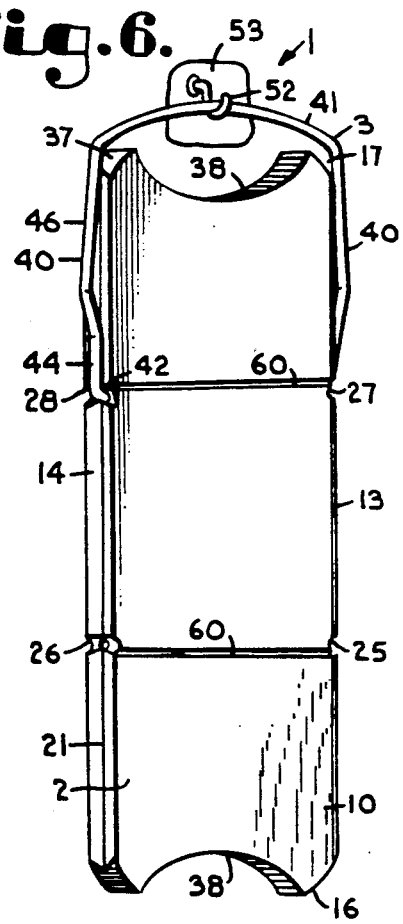
FIG. 6 is an enlarged perspective view of the device showing the bail in the storage position thereof and being hung on a storage hook.

As best shown in FIGS. 5 and 6 when the bail 3, secured in the bores 30 in the first and second slots 25 and 26, is placed in parallel alignment with the base 2 in a storage position thereof, a portion of the bail 3 including the arcuate cross-member 41 extends beyond and across the first end 16 of the base 2 so as to form a hand opening 50 for receiving a hand and/or suspension means such as the illustrated hook 52 mounted on a wall surface 53. Similarly, when the bail 3 is positioned in parallel alignment with the base 2 along the second end 17, a portion of the bail 3 including the arcuate cross-member 41 extends beyond and across the second end 17 so as to form an opening 50 for receiving a hand or suspension means. The cutout portions 38 of the first end 16 and the second end 17 cooperate with the bail 3 to increase the area of each respective opening 50 such that, when the bail 3 is positioned in a parallel alignment with the first and second faces 10 and 11 of the base 2, a hand of a user may be positioned through the opening 50 so as to grasp the bail 3.

Placing the bail 3 in parallel alignment with the base 2 allows the food slicing guide 1 to be more readily stored. In the storage configuration, the base 2 and bail 3 have a very low profile and a plane formed by passage through the bail 3 is substantially coplanar with the first and second faces 10 and 11 of the base 2. The creation of the opening 50 by positioning the bail 3 in parallel alignment with the base 2 allows the food slicing guide to be hung from a variety of suspension means, including pegs, hooks, nails or the like, for storage or decorative purposes. When the bail 3 is placed in parallel alignment with the base 2, a portion of each of the distal ends 42 of the bail 3 remains in the bores 30 and the opposing legs 40 bias against the first and second opposed sides 13 and 14 of the base 2 so as to secure the bail 3 to the base 2 when the base 2 is grasped or suspended by the bail 3.

To advance the bail 3 into perpendicular alignment with the base 2, the arcuate cross-member 41 is rotatably urged back over the base 2. As the bail 3 is advanced toward a perpendicular alignment with the base 2, the joged region 44 of each of the opposed legs 40 are urged out of the V-shaped grooves 20 and the lower portions 47 of the opposed legs 40 are biased to fully sit into the bores 30 of the first and second slots 25 and 26 or the third and fourth slots 27 and 28.

The bail 3 may be positioned in perpendicular alignment with the base 2 so as to extend away from either the first face 10 or the second face 11 when the bail 3 is positioned in either the first and second slots 25 and 26 or the third and fourth slots 27 and 28. Therefore, the bail 3 may be positioned so as to extend in perpendicular alignment above four different areas of the board.

A groove 60 extends across each face 10 and 11 of the base 2 between the slots 25 and 26 and between the slots 27 and 28. The grooves 60 are positioned to be in planar alignment with the front or cutting side 34 of the bail 3 when placed in respective slots 25 to 28. The slots 60 facilitate the passing of a cutting instrument through a lower side of food being sliced on the apparatus.

To use the food slicing guide 1 to guide a user in slicing an item of food 59, the bail 3 is positioned in perpendicular alignment relative to the base 2. The item of food 59 to be sliced is then positioned on either the first or second face 10 or 11 of the base 2 between the bail 3 and the base 2, as shown in FIG. 1, so that a portion of the item of food 59 to be sliced extends on a side of the bail 3 opposite of a remaining portion of the item of food 59. A user may then position a knife 60 or other cutting utensil against the cutting side 34 of the bail 3 and use the bail 3 as a guide in slicing the item of food 59 appropriately positioned on the base 2. The size of the slice may be varied by positioning more or less of the item of food 59 to be sliced on the side of the bail 3 opposite the remaining portion of the item of food 59.

The ability to position the bail 3 in perpendicular alignment with the base 2 in four different areas greatly increases the useful life of the food slicing guide by permitting the abrasion caused by contact between a knife 60 and the base 2 to be distributed at various times to any of the four different areas.

It is to be understood that while certain forms of the present invention have been illustrated and described herein, it is not to be limited to the specific forms or arrangement of parts described and shown.

What is claimed and desired to be secured by Letters Patent is as follows:

1. A food-slicing guide comprising:

(a) a base having a planar surface for supporting an item of food thereon; said base having opposed first and second sides aligned in parallel alignment; when said guide is operational, said first opposed side and said second opposed side including a first vertical slot and a second vertical slot respectively extending into said base and being aligned; said first and said second vertical slots including a bore extending from said first and said second vertical slots into said base first and said second vertical slots into said base perpendicular to said first and said second sides such that said bores in said first and said second vertical slots are axially aligned;

(b) said base surface is a first food-supporting surface and said base includes a parallel oppositely directed second food-supporting surface wherein said bail, rotatably received within said bores in said first and said second vertical slots, is alternatively positionable so as to extend perpendicular to said first food-supporting surface or said second food-supporting surface; and (c) a bail comprising a pair of opposed legs connected by a cross-member; each of said opposed legs having an inwardly directed distal end rotatably receivable within said bores in said first and said second vertical slots respectively, such that said bail is selectively positionable in a perpendicular alignment with respect to said base such that a lower portion of each of said opposed legs is abuttingly received within said first and said second vertical slots so as to maintain said bail in said perpendicular alignment and said bail is alternatively selectively positionable in a parallel alignment with said base surface such that said opposed legs biasingly engage said opposed sides.

2. The food-slicing guide as disclosed in claim 1 further comprising:

(a) a first groove and a second groove extending across said first food-supporting surface and said second food-supporting surface respectively so as to generally extend in alignment with and beneath said bail when said bail is perpendicularly aligned with respect to said first food supporting surface and said second food supporting surface respectively.

3. A food-slicing guide comprising:

(a) a base having a planar surface for supporting an item of food thereon; said base having opposed first and second sides aligned in parallel alignment; when said guide is operational, said first opposed side and said second opposed side including a first vertical slot and a second vertical slot respectively extending into said base and being aligned; said first and said second vertical slots each including a bore extending from said first and said second vertical slots into said base perpendicular to said first and said second sides respectively such that said bores in said first and said second vertical slots are axially aligned;

(b) a bail comprising a pair of opposed legs connected by a cross-member; each of said opposed legs having an inwardly directed distal end rotatably receivable within said bores in said first and said second vertical slots respectively, such that said bail is selectively positionable in a perpendicular alignment with respect to said base such that a lower portion of each of said opposed legs is abuttingly received within said first and said second vertical slots so as to maintain said bail in said perpendicular alignment and said bail is alternatively selectively positionable in a parallel alignment with said base surface such that said opposed legs biasingly engage said opposed sides and said cross-member of said bail extends across and beyond an end of said base so as to define a suspension opening therebetween; and (c) a third and a fourth vertical slot extending into said base and aligned directly opposite from each other; said third and fourth vertical slots including a bore extending from said third and fourth vertical slots into said base perpendicular to said first and said second opposed sides such that said bores in said vertical slots are linearly aligned; said bores in said third and said fourth vertical slots rotatably receiving said inwardly directed distal ends of said bail such that said bail is selectively positionable in said perpendicular alignment with said base such that a lower portion of each of said opposed legs is abuttingly received within said third and said fourth vertical slots so as to maintain said bail in said perpendicular alignment and said bail is selectively positionable in said alignment with said base such that said opposed legs biasingly engage said first and said second opposed sides and said cross-member of said bail extends across and beyond a second end of said base so as to define a suspension opening therebetween.

4. The food-slicing guide as disclosed in claim 3 wherein:

(a) said base includes a first food-supporting surface and an opposingly directed second food-supporting surface wherein said bail, rotatably received within said bores in said third and said fourth vertical slots, is alternatively positionable so as to extend perpendicular to said first food-supporting surface or said second food-supporting surface.

5. The food-slicing guide as disclosed in claim 4 further comprising:

(a) a longitudinal groove extending longitudinally and substantially across said first and said second opposed sides of said base and receiving said opposed legs of said bail when said bail is positioned in said alignment with said base.

6. The food-slicing guide as disclosed in claim 3 wherein:

(a) said second end of said base further includes a cutaway portion adapted to allow the positioning of a hand of a user between said second end and said cross-member of said bail.

* * * * *